US006279738B1

(12) United States Patent
Mungo et al.

(10) Patent No.: US 6,279,738 B1
(45) Date of Patent: Aug. 28, 2001

(54) FOAM PACKAGING TRAY AND PACKAGING METHOD USING SAME

(75) Inventors: Darren B. Mungo, Greenville; Joseph E. Owensby, Spartanburg, both of SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/335,000

(22) Filed: Jun. 17, 2000

(51) Int. Cl.[7] ..... B65D 81/28; B65D 1/34; B65B 31/04

(52) U.S. Cl. ..... 206/213.1; 206/557; 426/396; 426/129; 53/432; 53/441

(58) Field of Search ..... 206/213.1, 557; 426/107, 124, 129, 396; 53/432, 441

(56) References Cited

U.S. PATENT DOCUMENTS

| | | | | |
|---|---|---|---|---|
| 4,055,672 | | 10/1977 | Hirsch et al. . | |
| 4,057,651 | | 11/1977 | Florian . | |
| 4,933,193 | * | 6/1990 | Fisher | 426/107 |
| 4,935,089 | | 6/1990 | Schirmer . | |
| 5,155,974 | * | 10/1992 | Garwood | 53/432 X |
| 5,226,531 | | 7/1993 | Garwood . | |
| 5,241,149 | | 8/1993 | Wantanabe et al. . | |
| 5,346,735 | | 9/1994 | Logan et al. . | |
| 5,348,752 | | 9/1994 | Gorlich . | |
| 5,439,132 | | 8/1995 | Gorlich . | |
| 5,585,058 | | 12/1996 | Kolosowski . | |
| 5,631,036 | * | 5/1997 | Davis | 426/396 |
| 5,667,827 | * | 9/1997 | Breen et al. | 426/179 |
| 5,667,877 | * | 9/1997 | Breen et al. | 426/396 X |
| 5,686,126 | | 11/1997 | Noel et al. . | |
| 5,686,127 | * | 11/1997 | Stockley, III et al. | 426/396 X |
| 5,720,999 | | 2/1998 | Lanzani et al. . | |
| 5,776,390 | | 7/1998 | Fiddelaers et al. . | |
| 5,779,050 | | 7/1998 | Kocher et al. . | |
| 5,866,184 | * | 2/1999 | Gorlich | 426/396 |
| 5,916,613 | * | 6/1999 | Stockley, III | 426/124 |

FOREIGN PATENT DOCUMENTS

| | | |
|---|---|---|
| 0 721 899 A1 | 1/1996 | (EP) . |
| 0 644 849 B1 | 8/1998 | (EP) . |

* cited by examiner

*Primary Examiner*—Bryon P. Gehman
(74) *Attorney, Agent, or Firm*—Thomas C. Lagaly

(57) ABSTRACT

A foam sheet comprising a cellular structure having two or more interconnected cells in fluid communication with one another, the foam sheet being in the form of a tray. One or more perforations are provided in the exterior surface of the tray, and extend into the cellular structure of the foam sheet to fluidly communicate with the interconnected cells. This arrangement is sufficient to permit gas to escape from the cellular structure in order to substantially prevent damage to the tray upon exposure thereof to a reduction in ambient pressure. A method of making the trays and a packaging method employing such trays is also disclosed.

34 Claims, 4 Drawing Sheets

FOAM PACKAGING TRAY AND PACKAGING METHOD USING SAME

BACKGROUND OF THE INVENTION

The present invention relates generally to foam trays used for packaging applications and, more specifically, to foam trays used in vacuum packaging operations for, e.g., food products.

Various forms of packaging, particularly for food products, employ a relatively rigid support member, such as a foam tray, in which a product is supported. Substantially all of the air is evacuated from a predetermined space surrounding the tray and product, and the product is then covered by a lid, typically in the form of a relatively flexible, transparent film. The film is bonded to the tray around the product, generally by forming a heat-seal between the film and tray, to thereby enclose the product within the resultant package. Both the film and support member generally comprise materials which form a barrier to the passage of gas therethrough so that the entire package is substantially gas-impermeable. In this manner, the package protects and extends the shelf-life of the product. Examples of this type of packaging include vacuum skin packaging (VSP) and modified-atmosphere packaging (MAP).

In vacuum skin packaging, the film is thermoformable, i.e., capable of being formed into a desired shape upon the application of heat, and is thermoformed about the product on a tray by means of heat and differential pressure. Virtually all of the air is evacuated from a predefined space around the package so that, when the film is attached to the tray about the product and the resultant package is subsequently exposed to atmospheric pressure, the film is caused to conform very closely to the contour of the packaged product. Generally, sufficient heat is applied to cause the film to bond with the tray outside the periphery of the product, either by employing a heat-activatable adhesive at the interface of the film and tray or by forming the film and tray from materials that are otherwise sealingly compatible upon the application of heat, e.g., by employing similar polymeric materials, such as polyethylenes, at the seal interface that bond to one another when heated. Alternatively, a pressure-sensitive adhesive can be used. Further details are described in, e.g., U.S. Pat. Nos. Re 30,009 (Purdue et al.), U.S. Pat. No. 5,346,735 (Logan et al.), and U.S. Pat. No. 5,770,287 (Miranda et al.), the disclosures of which are hereby incorporated herein by reference.

In modified-atmosphere packaging, a food product is generally packaged in a tray having a peripheral flange to which a lidding film is secured. Prior to securing the film to the tray, air is generally evacuated from the interior of the tray and replaced by a gas which extends the shelf-life of the packaged product. In one type of MAP, a fresh red meat or other food product is packaged in a low-oxygen environment, e.g., carbon dioxide and/or nitrogen, after evacuating all or most of the air from the package. Since fresh red meat assumes a purple color in such a low-oxygen environment, to the dislike of most consumers, the lidding film contains a gas-impermeable portion that is peelably removable from a gas-permeable portion. At retail, the gas-impermeable portion is peeled from the package so that oxygen from the ambient atmosphere can enter the package via the remaining gas-permeable portion of the lid and cause the meat to "bloom," i.e., assume a bright red color that most consumers associate with freshness. Fresh meat remains in this state for about three days. Examples of this type of modified-atmosphere packaging are disclosed in U.S. Pat. Nos. 5,686,126 and 5,779,050, the disclosures of which are hereby incorporated herein by reference.

Another type of MAP employs a high-oxygen packaging environment for fresh red meat or poultry. This package is made by first evacuating the air from in and around a product-containing, gas-impermeable tray, introducing a high-oxygen environment (i.e., higher than the concentration of oxygen found in air), and then attaching a gas-impermeable lidding film to the tray to enclose the product therein. The high-oxygen environment serves to preserve the meat (e.g., by preventing microbial growth), but generally for a shorter period of time relative to a low-oxygen MAP. With a high-oxygen MAP, however, the meat remains in a constant state of bloom, due to the continued exposure to oxygen, so that a peelable lid is not needed.

In these and other lidded-tray type vacuum packaging operations, a problem that frequently occurs when using a foam tray is that the tray is damaged when the pressure is reduced during the process of removing air from the space around the tray and product. During the packaging operation, the tray-containing product is placed into a vacuum chamber, and the pressure is reduced very rapidly, e.g., from atmospheric pressure to less than about 300 milibars (a reduction of over 700 mbars) in a time period of less than about 10 seconds. Because of this rapid reduction in pressure, a sudden pressure differential develops between the pressure within the cells of the foam and the ambient atmosphere, i.e., the pressure surrounding the tray, such that the pressure within the foam cells is over 700 mbars higher than that of the ambient atmosphere. Such pressure differential causes an immediate tendency for the gas within the cells to expand. In brittle foams such as polystyrene, or in foams having mechanical defects, e.g., inconsistent cell size, this tendency towards expansion causes the gas in the cells to escape forcefully from the weaker cells and surge out of the foam, thereby rupturing cells and damaging the structural integrity of the foam.

An additional problem caused by the sudden pressure differential between the inside and outside of the foam during vacuum packaging is the delamination of a film that may be adhered to one or both major surfaces of the foam. While certain foams are sufficiently gas-impermeable for food packaging such as, e.g., PET foams, other foams, e.g., polystyrene foams, are insufficiently gas-impermeable such that a gas-impermeable film is often adhered to a surface of the foam in order to render a tray made from the foam gas-impermeable. Alternatively or in addition, a supporting film may be adhered to a surface of the foam in order to enhance the rigidity or crack-resistance of a tray made from the foam. When a sufficient amount of gas within the foam cells expands and escapes from the foam during evacuation, any such films, particularly gas-impermeable films, adhered to the foam tray are often caused to fully or partially delaminate by the escaping gas, thereby rendering the tray, and therefore the package, unusable.

Accordingly, there is a need in the art for an improved foam tray that is more suitable for vacuum packaging operations, i.e., one with increased resistance to damage upon exposure to a reduction in ambient pressure.

SUMMARY OF THE INVENTION

That need is met by the present invention which provides a foam sheet comprising a cellular structure having two or more interconnected cells in fluid communication with one another, the foam sheet being in the form of a tray comprising:

a. a base and four connected side-walls, each of the side-walls being further connected to and extending from the base to define a cavity, the tray having an interior surface adjacent the cavity and an exterior surface external to the cavity; and b. one or more perforations in the exterior surface of the tray, the perforations extending into the cellular structure of the foam sheet to fluidly communicate with the interconnected cells and being sufficient to permit gas to escape from the cellular structure in order to substantially prevent damage to the tray upon exposure thereof to a reduction in ambient pressure.

The invention also provides a method of packaging a product, comprising:

a. providing a tray as described above;

b. placing a product in the cavity of the tray;

c. exposing the tray and product to a reduction in ambient pressure, with the perforations permitting gas to escape from the cellular structure of the foam sheet in order to substantially prevent damage to the tray; and d. attaching a lid to the tray to enclose the product within the cavity.

The invention also pertains to a method of making a tray, comprising:

a. providing a foam sheet comprising a cellular structure having two or more interconnected cells in fluid communication with one another;

b. forming the foam sheet into a tray comprising a base and four connected side-walls, each of the side-walls being further connected to and extending from the base to define a cavity, the tray having an interior surface adjacent the cavity and an exterior surface external to the cavity; and c. producing one or more perforations in the exterior surface of the tray, the perforations extending into the cellular structure of the foam sheet to fluidly communicate with the interconnected cells and being sufficient to permit gas to escape from the cellular structure in order to substantially prevent damage to said tray upon exposure thereof to a reduction in ambient pressure.

DETAILED DESCRIPTION OF THE PREFERRED EMBODIMENTS

Figure 1:
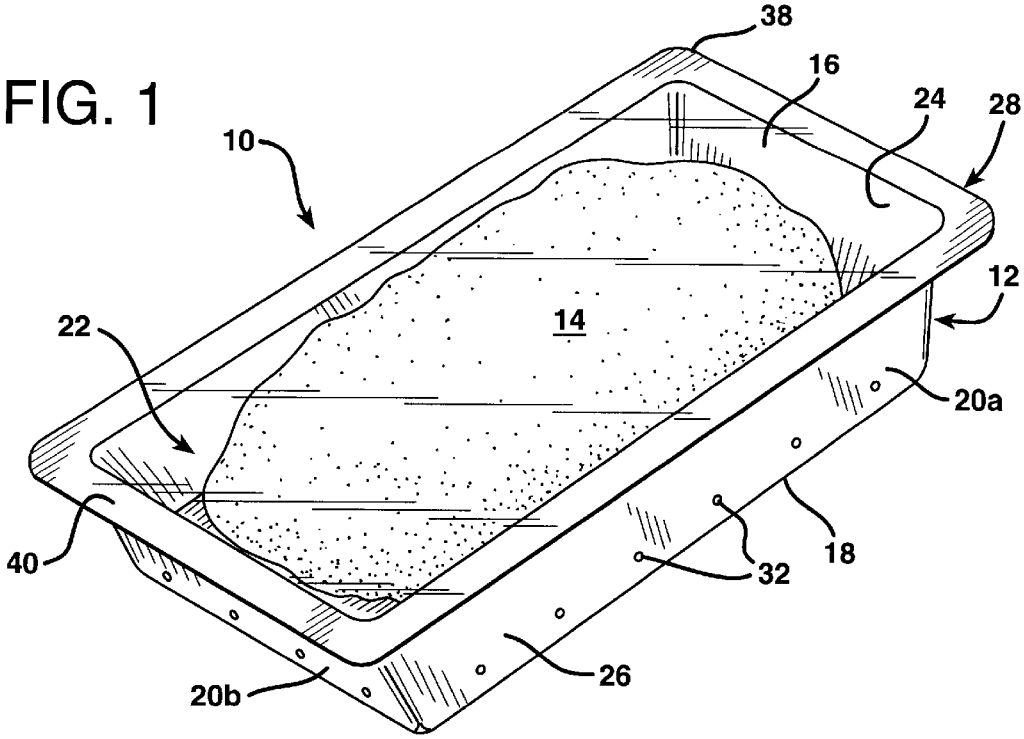
FIG. 1 is a perspective view of a modified-atmosphere package in accordance with the present invention, as taken from above the package, including a foam tray, product, and lid enclosing the product within the tray.
Figure 2:
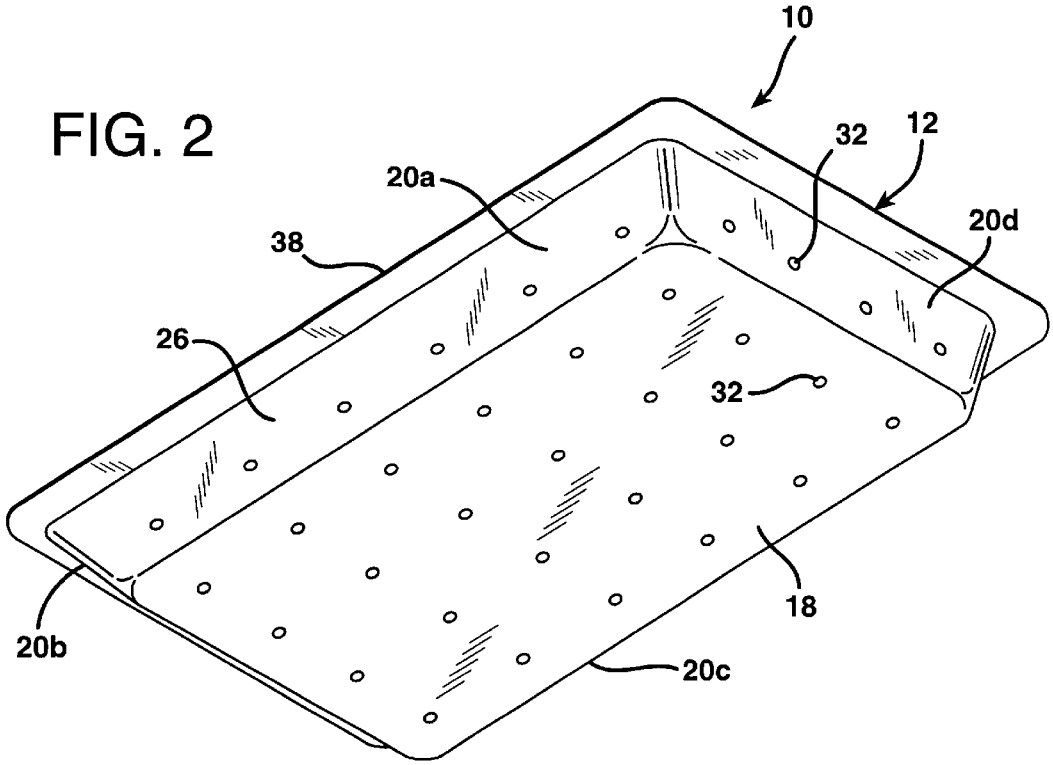
FIG. 2 is a perspective view of the modified-atmosphere package of FIG. 1, taken from the underside of the package.

FIGS. 1 and 2 illustrate a modified-atmosphere package 10 in accordance with the present invention, the package including a tray 12, product 14, and lid 16 attached to the tray such that the product is enclosed between the tray and lid. It should be understood that the present invention is equally applicable to other types of packaging, such as vacuum-skin packaging, and that a MAP is shown for illustrative purposes only without any intent to limit the invention.

Tray 12 is formed from a foam sheet, and comprises a base 18 and four connected side-walls 20*a–d*, with each of the side-walls being further connected to and extending from the base 18 to define cavity 22 in which product 14 is disposed. Tray 12 has an interior surface 24 adjacent cavity 22 and an exterior surface 26 external to the cavity.

Figure 3:
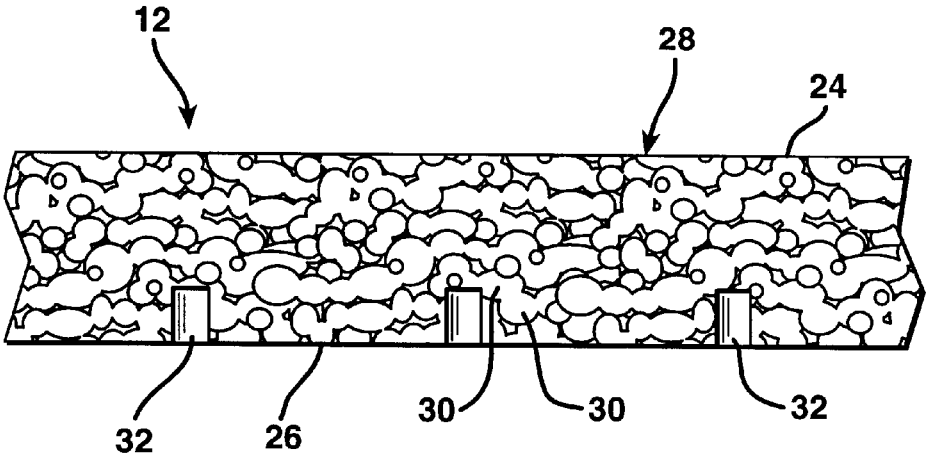
FIG. 3 is a partial, cross-sectional view of the foam sheet from which the tray shown in FIG. 1 is made.

As shown in FIG. 3, the foam sheet 28 from which tray 12 is formed comprises a cellular structure having two or more interconnected cells 30 in fluid communication with one another. Generally, such interconnected cells are adjacent cells that have opened during the formation of the foam such that the cell wall separating the two cells has developed an opening therein to permit communication between the two cells. This interconnection may also occur as a series of three or more cells in fluid communication. Depending on the foaming conditions and polymer forming the cell walls, there may be a plurality of such interconnected cell groupings randomly distributed throughout the foam. Some of the cells may also be closed cells interspersed among the interconnected/open cells as shown. A closed cell is one having no opening in the wall that forms the cell. Foams in accordance with the present invention preferably have between 20–90 percent by volume (based on the total volume of the foam) interconnected (open) cells and 10–80 vol. % closed cells. More preferably, such foams have between 30–80 vol. % interconected cells and 20–70% closed cells and, most preferably, between 30–60 vol. % interconnected cells and between 40–70 vol. % closed cells.

Significantly, in accordance with the present invention, one or more perforations 32 are provided in the exterior surface 26 of tray 12, with such perforations extending into the cellular structure of the foam sheet 28 to fluidly communicate with the interconnected cells 30. The perforations 32 are sufficient, in number and size, to permit gas to escape from the cellular structure of foam sheet 28 in order to substantially prevent damage to the tray upon exposure thereof to a reduction in ambient pressure, e.g., as would occur during vacuum packaging as explained above. The number and size of the perforations that are sufficient to permit enough gas to escape during exposure of the tray to a reduction in pressure is dependent on a number factors, including:

1) the type of foam, with more resilient or higher strength foams such as PET or PP foams needing fewer/ smaller perforations than more brittle foams such as polystyrene;

2) the ratio of interconnected v.s. closed cells in the foam, with the number and size requirements of the perforations increasing with a higher ratio of closed/ interconnected cells (unless the increased ratio of closed cells results in a stronger foam);

3) the extent to which the ambient pressure surrounding the tray is reduced, with greater pressure decreases necessitating more and/or larger perforations; and 4) the speed at which the pressure is reduced, with greater speed necessitating more and/or larger perforations.

In general, it is preferred that the number and size of the perforations be kept to a minimum, inasmuch as the rigidity and strength of the foam tray decreases with increasing perforation size and number. It has been found, however, that a suitable balance between sufficient gas flow during pressure reduction and minimal decrease in strength and rigidity can be achieved. For example, for trays formed from polystyrene foam sheet having a thickness of approximately 150 mils (1 mil=1/1000 inch), approximately 1 perforation/in$^2$, with each perforation having a diameter of approximately 30 mils and penetrating into the exterior surface of the tray to a depth ranging from about 50 to 100 mils, was sufficient to substantially reduce arid essentially eliminate damage to the trays when subjected to a reduction in ambient pressure from atmospheric pressure (approx. 1000 mbars) to about 5 mbars over a period of less than 2 seconds. Such conditions approximate the prevalent conditions to which foam trays are subjected in a typical low-oxygen type MAP operation.

The perforations 32 preferably extend no more than partially into the foam sheet 28. In this manner, the packaging environment in which the product 14 is packaged will be preserved. In addition, complete perforations would allow juices from packaged meat or poultry to leak from the package. Preferably, at least one perforation 32 is disposed in the base 18 and at least one perforation 32 is disposed in each of the side-walls 20*a–d*. Any suitable number of perforations 32 may be employed as noted above, ranging, e.g., from about 2 perforations/in$^2$ to about 1 perforation/2 in$^2$. The perforation diameter may range, e.g., from about 15 to about 60 mils, but preferably ranges from about 20 to about 40 mils. The perforation depth may range from about 5% of the foam sheet thickness, as measured from the exterior surface 26, to about 75% of the foam sheet thickness. Preferably, the perforation depth ranges from about 10% to about 50% of the foam sheet thickness.

Foam sheet 28 may be formed from any suitable or desired material and may comprise, e.g., at least one material selected from the group consisting of polyolefin (e.g., polyethylene or polypropylene), polystyrene, polyurethane, and polyester (e.g., PET), including blends of the foregoing materials. Such blends may include recycled scrap foam sheet blended with virgin polymer. The recycled foam sheet may include the foam itself plus any film(s) adhered thereto. A preferred polymer for meat packaging is polystyrene.

Figure 4:
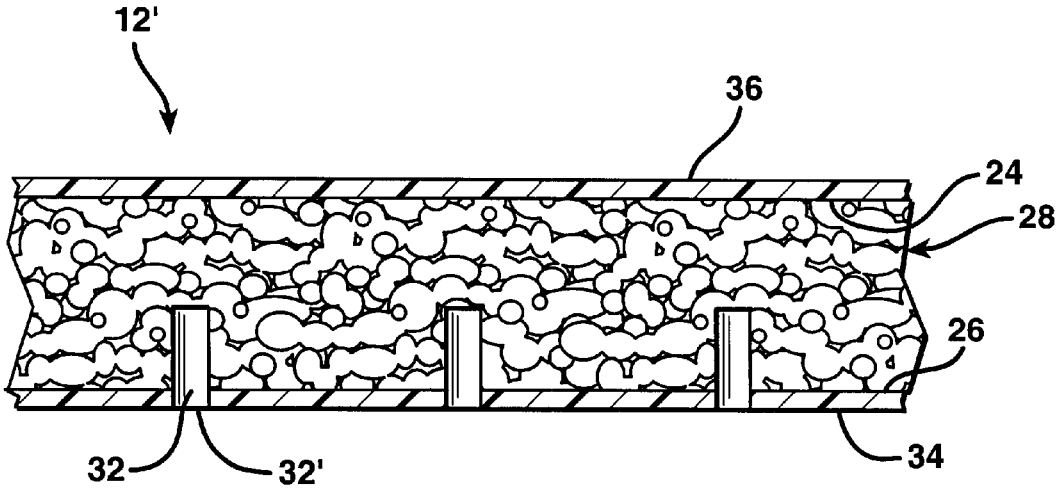
FIG. 4 illustrates an alternative embodiment of the foam sheet shown in FIG. 3, in which an interior film and an exterior film are adhered to both major surfaces of the foam sheet.

In an alternative embodiment, the foam sheet 28 may include a film adhered to one or both major surfaces thereof, i.e., to interior surface 24 and/or to exterior surface 26 of tray 12. Such alternative embodiment is illustrated in FIG. 4, wherein tray 12' includes an exterior film 34 in adherence with exterior surface 26. Such exterior film may be useful or necessary to enhance the strength, gas-impermeability, rigidity, and/or shatter resistance of the foam tray. When an exterior film 34 is included, it is preferred that such film has one or more perforations 32' therein aligned with perforations 32 in foam sheet 28. In this manner, the aforementioned function of perforations 32 will not be impeded by the inclusion of exterior film 34. Exterior film 34 may include any suitable material, such as, e.g., at least one material selected from the group consisting of polyolefin, polystyrene, polyester, polyamide, and blends of the foregoing materials. For example, when foam sheet 28 is formed from polystyrene, it is preferred that an exterior film 34 be included to enhance the rigidity and shatter resistance of tray 12', such film preferably comprising oriented polystyrene, high impact polystyrene, styrene/butadiene copolymer, or blends thereof.

Alternatively or in addition to an exterior film 34, tray 12' may include an interior film 36 in adherence with interior surface 24. Such interior film 36 may be desirable in order to increase the gas-impermeability of tray 12', enhance the ability of a lid to be sealed to the tray, provide a liquid barrier to any juices that may emanate from product 14, etc. In the case where it desirable to package product 14 under vacuum or in a modified-atmosphere, e.g., where product 14 is perishable in the presence of atmospheric concentrations of oxygen such as, e.g. meat, poultry, produce, etc., and foam sheet 28 is not sufficiently gas-impermeable, it is preferred that interior film 36 is substantially gas-impermeable. The interior film 36 may thus comprise at least one material selected from the group consisting of ethylene/vinyl alcohol copolymer, vinylidene chloride and copolymers thereof, acrylonitrile, polyester and copolymers thereof, polyamide, and blends of such materials. Suitable interior films for use in accordance with the present are described in U.S. Pat. Nos. 4,847,148 and 4,935,089, and in U.S. Ser. No. 08/326,176, filed Oct. 19, 1994 and entitled "Film/Substrate Composite Material" (published as EP 0 707 955 A1 on Apr. 24, 1996), the disclosures of which are hereby incorporated herein by reference.

Referring back to FIGS. 1 and 2, another preferred feature of tray 12 is a continuous flange 38 connected to and extending from side-walls 20*a–d* to define a surface 40 to which lid 16 may be attached in order to enclose product 14 within cavity 22. Tray 12 can have any desired configuration or shape, e.g., rectangular, square, round, oval, etc., with the depth of cavity 22 being of any desired dimension. Similarly, flange 38 may have any desired shape or design, including a simple, substantially flat design which presents a single sealing surface as shown, or a more elaborate design which presents two or more sealing surfaces, such as, e.g., the flange configurations disclosed in U.S. Pat. Nos. 5,348,752 and 5,439,132.

Although product 14 is illustrated as having a maximum height that is below the maximum height of tray 12, i.e., below the level at which flange 38 is located, the invention is not limited to such "low profile" products. Rather, "high profile" products may also be packaged in accordance with the present invention, i.e., those having a maximum height which is above the level at which flange 38 is located so that the portion of the product which extends above the level of flange 38 will be in direct contact with lid 16.

Figure 5:
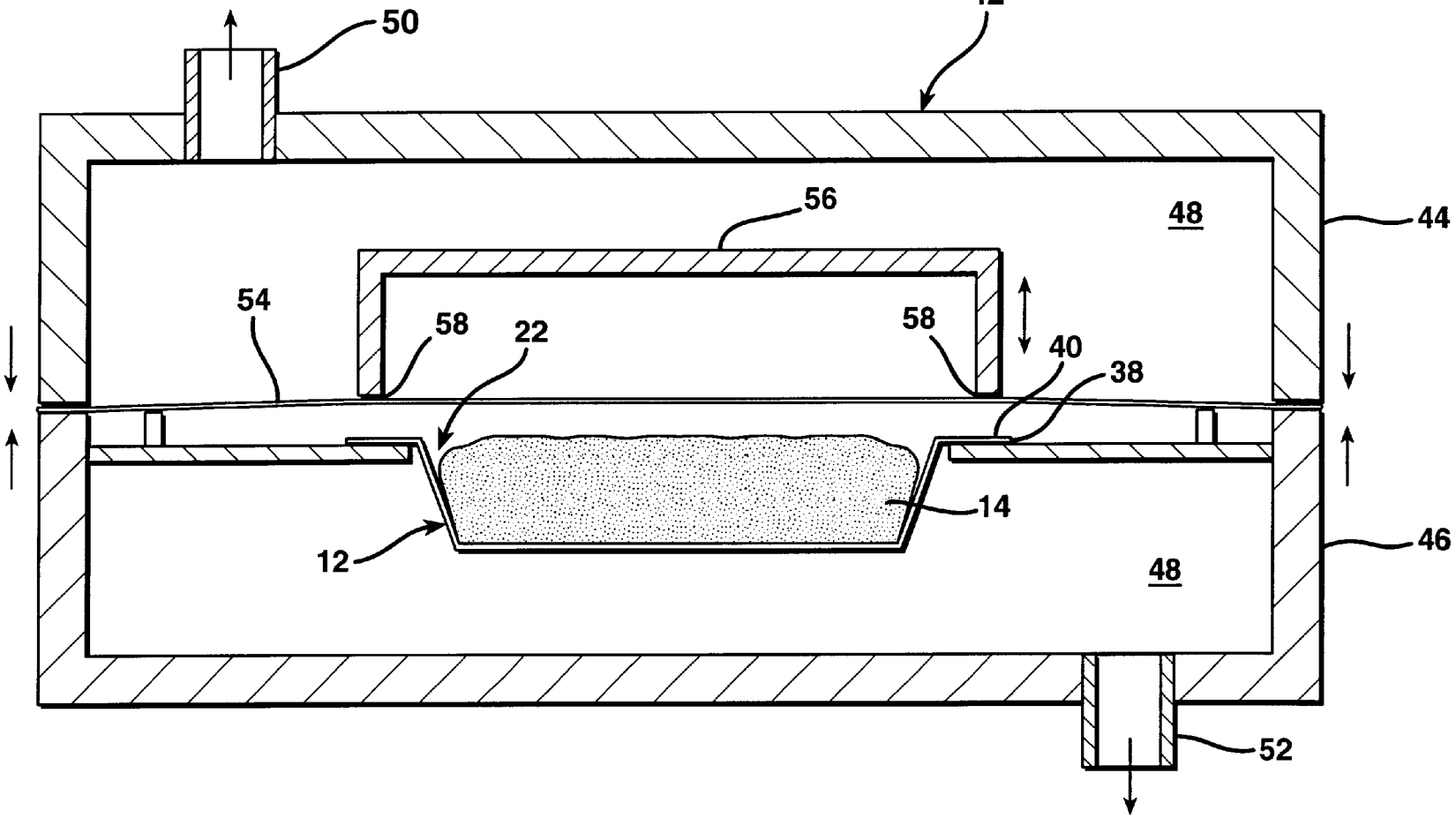
FIG. 5 is a schematic, cross-sectional view of a vacuum packaging process in accordance with the present invention.

Referring now to FIG. 5, a packaging method in accordance with the present invention will be described. The method includes placing product 14 into cavity 22 of tray 12. Alternatively, tray 12' may be used (as described above with regard to FIG. 4), or variations thereof with different types or combinations of films or with only one film may be used as desired. Tray 12 and product 14 are exposed to a reduction in ambient pressure in vacuum chamber 42, wherein upper and lower chamber halves 44 and 46 converge in the direction of the arrows and close around tray 12 and product 14 to form a sealed enclosure 48. Valves (not shown) in communication with exhaust ports 50 and 52 are then opened to a vacuum source (not shown), such as a single or separate vacuum pumps, which reduces the ambient pressure surrounding tray 12 and product 14 by removing substantially all of the air from sealed enclosure 48 as indicated by the arrows.

In general, when packaging fresh meat (e.g., beef, veal, lamb, pork, etc.), poultry or fish, the ambient pressure in vacuum chamber 42 is preferably reduced by at least about 700 milibars, i.e., to less than about 300 mbars, from atmospheric pressure (approximately 1000 mbars). For high-oxygen MAP, this pressure reduction preferably results in a final pressure in chamber 42 ranging from about 200 to about 50 mbars and, more preferably, from about 150 mbar to about 75 mbars, such pressure reduction taking place in less than about 10 seconds, more preferably in less than about 5 seconds and, most preferably, in less than about 2 seconds. Such speed is important to meeting the needs of modern, highspeed packaging requirements. For low-oxygen MAP and VSP packaging, the pressure reduction in vacuum chamber 42 preferably results in a final pressure of less than about 50 mbars, more preferably less than about 30 mbars, more preferably still less than about 20 mbars and, most preferably, less than about 10 mbars, again preferably in less than about 10 seconds, more preferably in less than about 5 seconds and, most preferably, in less than about 2 seconds.

As noted above, with conventional foam trays, such vacuum packaging process has been found to result in damage to the cellular structure of the tray and delamination of any film(s) that may be adhered thereto. In accordance with the present invention, such tray damage is avoided by providing one or more perforations 32 in the exterior surface of the tray (see FIGS. 1–4), the perforations permitting gas to escape from the cellular structure of foam sheet 28 during pressure reduction in vacuum chamber 42.

After the desired pressure has been achieved in sealed enclosure 48, the final step in the packaging process is to attach lid 16 to tray 12 in order to enclose product 14 within cavity 22. This may be accomplished as shown by suspending web 54 of lidding film above tray 12 and product 14 in vacuum chamber 42 as shown. After the pressure has been sufficiently reduced, web 54 is moved into contact with flange 38 of tray 12 and attached thereto by any suitable means. This is preferably carried out by translating seal bar 56 downwards as indicated by the arrow until the ends 58 contact web 54, and further press web 54 into contact with the upper surface 40 of flange 38. Seal bar 56 then applies heat and continued pressure to web 54 at flange 38 in a downward direction to thereby effect a heat-seal between the web and flange. The heat and pressure applied by seal bar 56 are preferably sufficient to cause the web 54 and tray 12 at flange 38 to fuse together, thereby creating a hermetic enclosure for product 14. Thereafter, the seal bar 56 is raised to the starting position shown in FIG. 5, the chamber halves 44, 46 are opened, and lid 16 is severed from web 54 by a suitable cutting device (not shown).

Suitable equipment for carrying out the aforedescribed packaging method is commercially available by, e.g., Ross Industries, Inc. or Multivac, Inc., such as the Ross Inpack® 3320 or the Multivac® T500 packaging machines. Further details concerning the packaging process are described in the above-referenced U.S. Pat. No. 5,779,050.

The foregoing packaging method is ideally suited for products that are perishable in the presence if air such as, e.g., fresh red meat products (e.g., beef, veal, lamb, pork, etc.), poultry (chicken, turkey, etc.), fish, cheese, produce (fruits and vegetables), etc. When such products are to be packaged, it is preferred that both tray 12 and lid 16 are substantially gas-impermeable, and that they are attached with a hermetic seal, e.g., a heat seal as described above, in order to form a substantially gas-impermeable enclosure. As used herein, the phrase "substantially gas-impermeable" refers to a film or tray that admits less than 1000 cc of gas, such as oxygen, per square meter of film per 24 hour period at 1 atmosphere and at a temperature of 73° F. (at 0% relative humidity). More preferably, a substantially gas-impermeable film or tray admits less than about 500, such as less than 300, and less than 100 cc of gas; more preferably still less than about 50 cc, and most preferably less than 25 cc, such as less than 20, less than 15, and less than 10 cc of gas per square meter per 24 hour period at 1 atmosphere and at a temperature of 73° F. (at 0% relative humidity).

Any desired amount of air may be removed from the enclosure 48 of vacuum chamber 42 during the evacuation step, e.g., ranging from 1% to 99.999% by volume. In the case where a fresh red meat or poultry product is to be packaged, the amount of air removed preferably ranges from about 99% to about 99.999%, and more preferably from about 99.5% to about 99.999% by volume. As a result, the cavity 22 of package 10 will preferably contain less than 1% oxygen by volume, more preferably less than 0.5% oxygen, even more preferably less than 0.1% oxygen, and most preferably, less than 0.05% oxygen by volume. If package 10 is to be a vacuum-skin package (VSP), substantially no gasses will be present in cavity 22. Alternatively, when package 10 is a modified-atmosphere package, following the reduction in ambient pressure in vacuum chamber 42, a gas that extends the shelf-life of the product 14 is introduced to into enclosure 48, e.g., via port 50 and/or 52, prior to the attachment of lid 16. By thus introducing such a gas to cavity 22 and product 14 prior to securing lid 16 to tray 12, the gas is contained within package 10 and surrounds product 14, e.g., to extend the shelf-life thereof or to provide other intended benefits as desired. Preferred gases to replace the evacuated air include, e.g., carbon dioxide, nitrogen, argon, etc., and mixtures of such gases, such as a mixture of carbon dioxide and nitrogen.

Lid 16 is preferably a substantially transparent, flexible film, which may be supplied as a web 54 as shown in FIG. 5, e.g., from a storage roll (not shown). When package 10 is to be a non-peelable VSP or MAP package, such as a high-oxygen package as described earlier herein, the only additional requirements that are preferred for lid 16 is that it be sealable to tray 12 and, for packaging perishable foods such as fresh meat or poultry products, that it be substantially gas-impermeable. When package 10 is a peelable VSP or MAP package, a further requirement is that film 16 be peelably delaminatable into gas-permeable and gas-impermeable portions, with the gas-permeable portion remaining attached to the package and the gas-impermeable portion being peelably removable at retail so that the packaged fresh meat or poultry product is allowed to bloom to a red or, in the case of fresh poultry, pink color that consumers associate with freshness, while the remaining gas-permeable lid portion continues to protect the product by preventing contact with dust, dirt, moisture, and other contaminates while the package is displayed for sale at retail. A preferred peelable film for peelable VSP packaging is described in the above-referenced U.S. Pat. No. 5,770,287. Preferred films for peelable MAP applications are disclosed in the above-referenced U.S. Pat. No. 5,686,126, and also in U.S. Ser. No. 08/764,405 filed Dec. 11, 1996 and entitled LAMINATE HAVING A COEXTRUDED, MULTILAYER FILM WHICH DELAMINATES AND PACKAGE MADE THEREFROM, the disclosure of which is hereby incorporated herein by reference.

Figure 6:
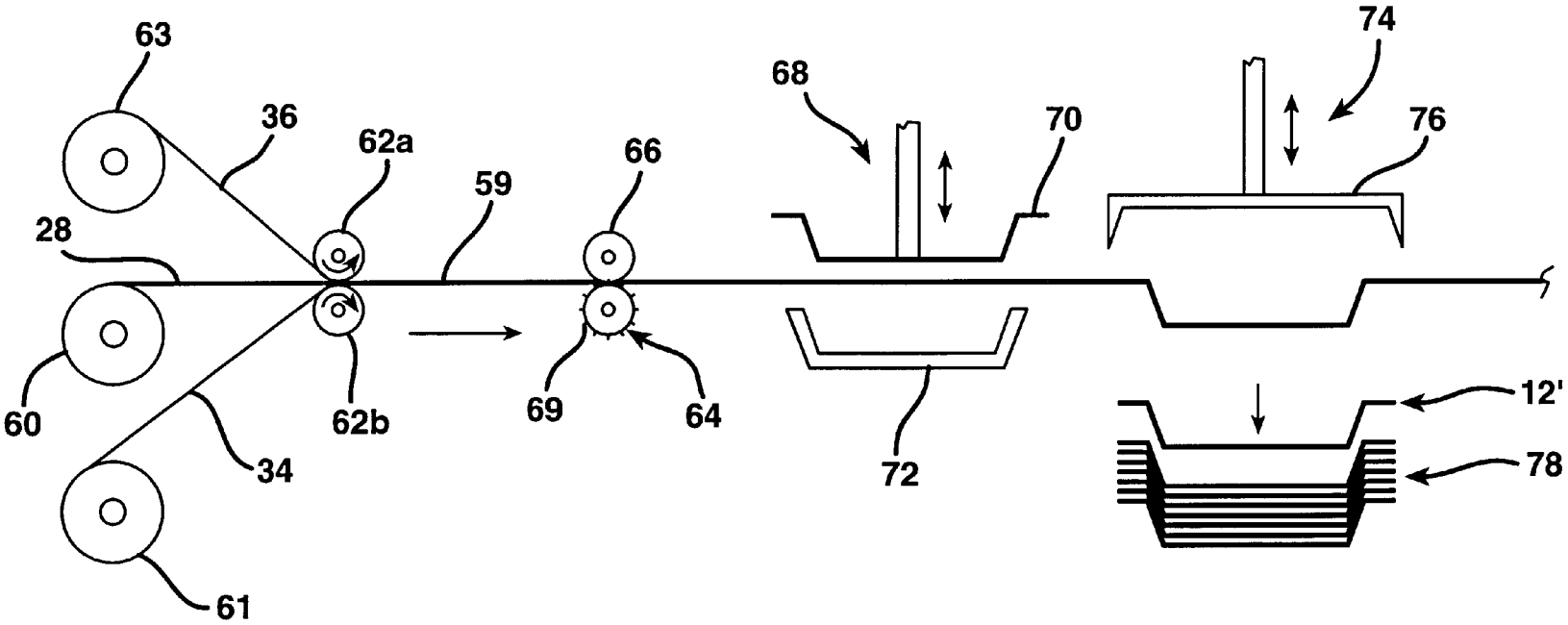
FIG. 6 is a schematic view of a process for making trays in accordance with the present invention.

Referring now to FIG. 6, a preferred method for making a tray in accordance with the present invention will be described. Essentially, the method includes the steps of a. providing a foam sheet 28 as described above;

b. forming foam sheet 28 into a tray 12 (or 12') as described above; and c. producing one or more perforations 32 in the exterior surface 26 of the tray as described above. The step of producing the perforations may occur before or after the forming step as desired. In the process illustrated in FIG. 6 and described below, the perforations are produced prior to forming the foam sheet into a tray. However, the perforations can also be formed in the side-walls and/or base of the tray after the tray has been formed.

Foam sheet 28 is preferably provided as a continuous web from storage roll 60, from which the sheet is unwound via nip rolls 62*a* and 62*b*. Nip rolls 62*a–b* rotate in opposite directions to move the foam sheet in the direction of the arrow. In producing trays 12' as shown, exterior film 34 and interior film 36 may be similarly provided as webs from respective storage rolls 61 and 63, and are laminated to opposite surfaces of foam sheet 28 in nip rolls 62*a–b* to form composite web 59. The nip rolls can be heated if desired to facilitate the lamination process. Alternatively, films 34 and/or 36 can be adhered to foam sheet 28 via coextrusion, extrusion-coating, coextrusion-coating, vapor deposition, or any suitable process for adhering the films to the foam sheet.

Perforator roll 64 rotates against backer roll 66, and composite web 59 is passed between rolls 64 and 66 to simultaneously produce perforations 32' in the exterior film 34 and perforations 32 in the exterior surface 26 of foam sheet 28 as shown in FIG. 4. Forming the perforations 32, 32' simultaneously facilitates their alignment with one another. Perforator roll 64 includes an array of perforation needles 69 arranged to provide a desired perforation pattern on web 59 and on the resultant trays 12'. The diameter and length of the perforation needles is selected to provide a desired diameter and depth of perforations 32 in the resultant tray. The needles 69 may optionally be heated to facilitate the perforation process.

Forming station 68 is preferably a thermoforming apparatus including a stamping device 70, which reciprocates against correspondingly shaped and stationary receiving mold 72. Trays are thus formed in the shape of stamping device 70 and receiving mold 72 when the stamping device 70 moves against composite web 59 and presses it into receiving mold 72 with sufficient heat and pressure to cause the foam/film composite web to assume the shape of the stamp and receiving mold. Stamping device 70 and/or receiving mold 72 are preferably heated to facilitate the thermoforming process. If desired, vacuum ports (not shown) in communication with a vacuum source may be provided in receiving mold 72 in order to further facilitate the thermoforming process by pulling the web 59 against the mold 72.

After the trays have been formed in station 68, the web 59 is indexed to cutting station 74, wherein cutting device 76 severs trays 12' from the web. The severed trays then drop out of the web and into stack 78 for subsequent removal and use. The remainder of the composite web may be processed as scrap, preferably by grinding and pelletizing the scrap and recycling it, e.g., by blending it with virgin polymer to make foam sheet 28 as disclosed, e.g., in U.S. Pat. No. 5,118,561.

Although the foregoing process has been described in connection with the production of tray 12' as shown and described with reference to FIG. 4, it is to be understood that the process is equally applicable to the production of tray 12 as shown and described with reference to FIG. 3, by simply omitting films 34 and 36.

EXAMPLES

For each of the following examples, composite foam trays were produced in accordance with the above-referenced U.S. Ser. No. 08/326,176 and as shown in FIG. 6, resulting in the three-layer structure shown in FIG. 4. The exterior film (34) was oriented polystyrene film, the foam sheet (28) was foamed polystyrene (foamed with a blend of pentane and carbon dioxide as the blowing agent) blended with recycled scrap from prior production of trays having the same composite structure, and the interior film (36) had the following structure:

LLDPE/EVA/TIE/EVOH/TIE/EVA/SBC where:

"LLDPE" is a layer comprising DOWLEX 2244A (TM) heterogeneous ethylene/octene copolymer having a melt index of 3.3 and a density of 0.916 g/cc; obtained from The Dow Chemical Company, of Midland, Mich.

"EVA" is a layer comprising ELVAX 3165 (TM) ethylene/vinyl acetate copolymer having 18 percent by weight of vinyl acetate, a melt index of 0.7 and a density of 0.94 g/cc; obtained from E.I. Dupont de Nemours, of Wilmington, Del. (both "EVA" layers in the above film structure are the same).

"TIE" is a layer comprising TYMOR 1203 (TM) anhydride-grafted linear low density polyethylene having a melt index of 1.6 and a density of 0.910 g/cc; obtained from Morton International of Chicago, Ill. (both "TIE" layers in the above film structure are the same).

"EVOH" is a layer comprising LC-H101BD (TM) ethylene/vinyl alcohol copolymer having 38mole percent of ethylene, a melt index of 1.5 and a melt point of 175° C.; obtained from EVAL Co. of America, of Lisle, Ill; and "SBC" is a layer comprising KK36 (TM) styrene/butadiene copolymer having 75 percent by weight of styrene, a melt index of 8.0 (Condition G of ASTM D-1238) and a density of 1.01 g/ cc, obtained from Phillips 66, of Pasadena, Tex.

The interior and exterior films had a thickness of approximately 1 mil and the foam portion had a thickness ranging from about 110 to about 170 mils.

Example 1

Approximately 70 composite foam trays as described above, having the dimensions (L×W×D) 6"×6"×2", were tested in a vacuum chamber that reduced the ambient pressure around the trays from about 1000 mbars to about 5 mbars in less than 2 seconds. The trays were of marginal quality, with uneven cell size distribution. Half of the trays were perforated in accordance with the present invention on the outer surface thereof with perforation needles having a diameter of 30 mils, to a depth of approximately 40% of the tray wall thickness, and spaced at about 1 perforation/in$^2$. Approximately 40% of the non-perforated trays failed, i.e., were structurally damaged due to rupture of the foam cell walls and/or exhibited delamination of the interior film. On the other hand, only about 4% of the perforated trays exhibited such damage.

Example 2

Approximately 100 composite trays as described above, judged to be of good quality (even cell size distribution), were tested in a vacuum chamber as in Example 1. The trays had the dimensions (L×W×D) 9"×7"×2". Half of the trays were perforated in accordance with the invention on the outer surface with perforation needles having a diameter of 30 mils, to a depth of approximately 40% of the tray wall thickness, and spaced at approx. 1 perforation/in$^2$. Perforation occurred prior to thermoforming the laminated film/foam/film web into trays. Approximately 6% of the non-perforated trays failed, i.e., were structurally damaged due to rupture of the foam cell walls and/or exhibited delamination of the interior film. On the other hand, none of the perforated trays exhibited such damage.

Example 3

Approximately 250 composite trays as described above, judged to be of good quality (even cell size distribution), were tested in a vacuum chamber as in Example 1. The trays had the dimensions (L×W×D) 6"×6"×2.5". Half of the trays were perforated in accordance with the present invention on the outer surface with perforation needles having a diameter of 15 mils, to a depth of approximately 58% of the tray wall thickness, and spaced at about 1 perforation/in$^2$. Perforation occurred prior to thermoforming the laminated film/foam/film web into trays. Approximately 6% of the non-perforated trays failed, i.e., were structurally damaged due to rupture of the foam cell walls and/or exhibited delamination of the interior film. On the other hand, none of the perforated trays exhibited such damage.

While the invention has been described with reference to illustrative examples, those skilled in the art will understand that various modifications may be made to the invention as described without departing from the scope of the claims which follow.

What is claimed is:

1. A foam sheet comprising a cellular structure having two or more interconnected cells in fluid communication with one another, said foam sheet being in the form of a tray comprising:

a. a base and four connected side-walls, each of said side-walls being further connected to and extending from said base to define a cavity, said tray having an interior surface adjacent said cavity, an exterior surface external to said cavity, and an exterior film adhered to said exterior surface; and b. one or more perforations in said exterior film and in said exterior surface of said tray, said one or more perforations in said exterior film being aligned with said one or more perforations in said tray, said one or more perforations in said tray extending into said cellular structure of said foam sheet to fluidly communicate with said interconnected cells and being sufficient to permit gas to escape from said cellular structure in order to substantially prevent damage to said tray upon exposure thereof to a reduction in ambient pressure.

2. The foam sheet of claim 1, wherein said one or more perforations extend no more than partially into said foam sheet.

3. The foam sheet of claim 1, wherein at least one of said one or more perforations is disposed in said base and at least one of said one or more perforations is disposed in each of said side-walls.

4. The foam sheet of claim 1, wherein said foam sheet comprises at least one material selected from the group consisting of polyolefin, polystyrene, polyurethane, polyester, and blends of the foregoing materials.

5. The foam sheet of claim 1, wherein said exterior film comprises at least one material selected from the group consisting of polyolefin, polystyrene, polyester, and polyamide.

6. The foam sheet of claim 1, further including an interior film adhered to said interior surface of said tray.

7. The foam sheet of claim 6, wherein said interior film is substantially gas-impermeable.

8. The foam sheet of claim 1, further including a continuous flange connected to and extending from said side-walls to define a surface to which a lid may be attached in order to enclose a product within said cavity.

9. A method of packaging a product, comprising:

a. providing a foam sheet comprising a cellular structure having two or more interconnected cells in fluid communication with one another, said foam sheet being in the form of a tray comprising:

1) a base and four connected side-walls, each of said side-walls being further connected to and extending from said base to define a cavity, said tray having an interior surface adjacent said cavity and an exterior surface external to said cavity, and 2) one or more perforations in said exterior surface of said tray, said one or more perforations extending into said cellular structure of said foam sheet to fluidly communicate with said interconnected cells;

b. placing a product in said cavity;

c. exposing said tray and product to a reduction in ambient pressure, with said one or more perforations permitting gas to escape from said cellular structure of said foam sheet in order to substantially prevent damage to said tray, and then introducing a gas to said product that extends the shelf-life of the product; and d. attaching a lid to said tray to enclose the product within said cavity.

10. The method of claim 9, wherein said product is selected from the group consisting of meat, poultry, produce, and cheese.

11. The method of claim 9, wherein said ambient pressure is reduced by at least about 700 milibars.

12. The method of claim 9, wherein said lid is a substantially transparent, flexible film.

13. The method of claim 12, wherein said lid is substantially gas-impermeable.

14. The method of claim 9, wherein said one or more perforations extend no more than partially into said foam sheet.

15. The method of claim 9, wherein at least one of said one or more perforations is disposed in said base and at least one of said one or more perforations is disposed in each of said side-walls.

16. The method of claim 9, wherein said foam sheet comprises at least one material selected from the group consisting of polyolefin, polystyrene, polyurethane, polyester, and blends of the foregoing materials.

17. The method of claim 9, wherein an exterior film is adhered to said exterior surface of said tray, said film having one or more perforations aligned with said one or more perforations in said tray.

18. The method of claim 17, wherein said exterior film comprises at least one material selected from the group consisting of polyolefin, polystyrene, polyester, polyamide, and blends of the foregoing materials.

19. The method of claim 9, wherein an interior film is adhered to said interior surface of said tray.

20. The method of claim 9, wherein said interior film is substantially gas-impermeable.

21. The method of claim 9, wherein said tray further includes a continuous flange connected to and extending from said side-walls to define a surface to which said lid is attached.

22. A package made by the method of claim 9.

23. A method of making a tray, comprising:

a. providing a foam sheet comprising a cellular structure having two or more interconnected cells in fluid communication with one another;

b. forming said foam sheet into a tray comprising a base and four connected side-walls, each of said side-walls being further connected to and extending from said base to define a cavity, said tray having an interior surface adjacent said cavity, an exterior surface external to said cavity, and an exterior film adhered to said exterior surface; and c. producing one or more perforations in said exterior film and in said exterior surface of said tray, said one or more perforations in said exterior film being aligned with said one or more perforations in said tray, said one or more perforations in said tray extending into said cellular structure of said foam sheet to fluidly communicate with said interconnected cells and being sufficient to permit gas to escape from said cellular structure in order to substantially prevent damage to said tray upon exposure thereof to a reduction in ambient pressure.

24. The method of claim 23, wherein said one or more perforations extend no more than partially into said foam sheet.

25. The method of claim 23, wherein at least one of said one or more perforations is disposed in said base and at least one of said one or more perforations is disposed in each of said side-walls.

26. The method of claim 23, wherein said foam sheet comprises at least one material selected from the group consisting of polyolefin, polystyrene, polyurethane, polyester, and blends of the foregoing materials.

27. The method of claim 23, wherein said exterior film comprises at least one material selected from the group consisting of polyolefin, polystyrene, polyester, polyamide, and blends of the foregoing materials.

28. The method of claim 23, further including the step of adhering an interior film to said interior surface of said tray.

29. The method of claim 28, wherein said interior film is substantially gas-impermeable.

30. The method of claim 23, wherein said tray further includes a continuous flange connected to and extending from said side-walls to define a surface to which a lid may be attached in order to enclose a product within said cavity.

31. The method of claim 23, wherein said step of producing one or more perforations occurs before said step of forming said foam sheet into a tray.

32. The method of claim 23, wherein said step of producing one or more perforations occurs after said step of forming said foam sheet into a tray.

33. A tray made by the method of claim 23.

34. A method of packaging a product, comprising:

a. providing a foam sheet comprising a cellular structure having two or more interconnected cells in fluid communication with one another, said foam sheet being in the form of a tray comprising:

1) a base and four connected side-walls, each of said side-walls being further connected to and extending from said base to define a cavity, said tray having an interior surface adjacent said cavity, an exterior surface external to said cavity, and an exterior film adhered to said exterior surface, and 2) one or more perforations in said exterior film and in said exterior surface of said tray, said one or more perforations in said exterior film being aligned with said one or more perforations in said tray, said one or more perforations in said tray extending into said cellular structure of said foam sheet to fluidly communicate with said interconnected cells;

b. placing a product in said cavity;

c. exposing said tray and product to a reduction in ambient pressure, with said perforations permitting gas to escape from said cellular structure of said foam sheet in order to substantially prevent damage to said tray; and d. attaching a lid to said tray to enclose the product within said cavity.

* * * * *